US005507170A

United States Patent [19]

Kawano

[11] Patent Number: 5,507,170

[45] Date of Patent: Apr. 16, 1996

[54] UPPER TOOL FOR PRESS BRAKE

[75] Inventor: Susumu Kawano, Atsugi, Japan

[73] Assignee: Amada Metrecs Company, Limited, Kanagawa, Japan

[21] Appl. No.: 243,937

[22] Filed: May 18, 1994

Related U.S. Application Data

[63] Continuation-in-part of Ser. No. 177,988, Jan. 6, 1994.

[30] Foreign Application Priority Data

May 18, 1993 [JP] Japan ..... 5-115655
May 18, 1993 [JP] Japan ..... 5-115665

[51] Int. Cl.[6] ..... B21D 37/04

[52] U.S. Cl. ..... 72/482.91; 72/462

[58] Field of Search ..... 72/389, 481, 482, 72/462

[56] References Cited

U.S. PATENT DOCUMENTS

| | | | |
|---|---|---|---|
| 2,755,758 | 7/1956 | Johansen | 113/49 |
| 4,590,788 | 5/1986 | Wallis | 72/481 |
| 4,598,574 | 7/1986 | Hegel et al. | 72/481 |
| 4,787,237 | 11/1988 | Houston et al. | 72/462 |
| 4,895,014 | 1/1990 | Houston | 72/481 |
| 4,993,255 | 2/1991 | Treillet | 72/462 |
| 5,022,256 | 6/1991 | van der Meulen | 72/481 |
| 5,245,854 | 9/1993 | Bruggink et al. | 72/481 |

FOREIGN PATENT DOCUMENTS

| | | | |
|---|---|---|---|
| 0237800 | 9/1987 | European Pat. Off. . | |
| 0387121A1 | 9/1990 | European Pat. Off. . | |
| 0569880 | 11/1993 | European Pat. Off. . | |
| 2339485 | 8/1979 | France . | |
| 2609909 | 7/1988 | France . | |
| 3136440A1 | 3/1983 | Germany . | |
| 3524694A1 | 1/1987 | Germany . | |
| 3932629 | 4/1990 | Germany . | |
| 4115224 | 11/1992 | Germany | 72/481 |
| 62-54524 | 3/1987 | Japan . | |
| 62-212019 | 9/1987 | Japan . | |
| 62-267019 | 11/1987 | Japan . | |
| 1175602A | 8/1985 | U.S.S.R. . | |
| 2057047 | 3/1981 | United Kingdom . | |

*Primary Examiner*—David Jones
*Attorney, Agent, or Firm*—Wigman, Cohen, Leitner & Myers

[57] ABSTRACT

An upper tool for a press brake includes a push actuating section (9K, 107, 9U) for actuating upward an actuated member (17, 103P, 121) movable up and down, in a clamping force increasing mechanism such that an upper tool clamping force can be increased gradually when the actuated member (17, 103P, 121) mounted on an upper holder device (1) of the press brake is moved upward. An example of the push actuating section is a lower surface of an engage groove portion (9K) extending horizontally and formed in any of front and rear surfaces of the upper tool (9). Further, the engage groove portion (9K) is formed between a vertical position roughly the same as a holder contact surface (9F) formed at a shoulder portion of the upper tool (9) and another vertical position slightly lower than an upper end of the upper tool.

13 Claims, 9 Drawing Sheets

UPPER TOOL FOR PRESS BRAKE

This application is a C-I-P application of application Ser. No. 08/177,988, filed Jan. 6, 1994.

BACKGROUND OF THE INVENTION

1. Field of the Invention

The present invention relates to an upper tool removably attached to an upper tool holder device for a press brake, and more specifically to an upper tool which can actuate the upper tool holder device so that the clamping force can be increased when attached to the upper tool holder device.

2. Description of the Related Art

As is well known, the structure of a press brake is such that an upper table (referred to as an upper apron, sometimes) and a lower table (referred to as a lower apron, sometimes) are provided so as to be opposed vertically to each other and further any one of the upper and lower tables is moved up and down relative to the other as a ram.

Further, in the press brake, an upper tool is attached to the lower portion of the upper table and a lower tool is attached to the upper portion of the lower table.

In the above-mentioned structure, workpiece disposed between the upper and lower tools can be bent when both the tools are engaged with each other by moving the movable-side table up and down.

In the above-mentioned press brake, in order to exchange an upper tool with another upper tool according to the bending shape of workpiece, a number of upper tool holder devices are attached to the lower portion of the upper table, and further a number of tools are removably supported by a number of the upper tool holder devices, respectively.

Here, in the conventional upper tool holder device, an upper tool clamp is mounted on a holder body attached to the lower portion of the upper table, and the upper portion of the upper tool is strongly fastened and fixed between the holder body and the upper tool clamp when the upper clamp is fastened with fastening bolts.

In the conventional upper tool holder device, therefore, a great number of fastening bolts arranged on a number of upper tool holder devices must be rotated in order to exchange the upper tool on the upper table, thus causing a problem in that the tool exchange process is complicated and therefore troublesome.

To overcome the above-mentioned problem, another upper tool holder device has been so far proposed such that an air cylinder is attached for each upper tool holder device to fasten and unfasten the upper tool clamp with the use of the respective attached air cylinder.

In this conventional art upper tool holder device, however, since a number of air cylinders must be provided for a number of the upper tool holder devices independently, and further since an air source is required additionally, there exists another problem in that the structure is complicated and therefore the manufacturing cost thereof is high.

Further, in the conventional art upper tool holder device, whenever tile upper tool is unclamped by releasing the upper tool clamp provided for the upper tool holder device, there exists a danger that the released upper tool will fall down. Further, in the prior art upper tool holder device, during the upper tool setting work, since the upper tool must be first fastened slightly to such an extent that the upper tool will not fall and then the upper tool must be fastened strongly with the upper tool clamp after the alignment of both the upper and lower tools has been confirmed, there exists another problem in that the upper tool setting process is troublesome.

Further, there is another conventional art as disclosed in EP-0 387 121 A1 related to the present invention, whose structure is such that an upper tool is clamped between an upper tool holder body and an upper tool clamp pivotally attached to the upper table of a press brake. In this conventional structure, however, since the upper tool must be attached to and removed from the upper tool holder body by pivoting the upper tool about the pivotal axle of the upper tool clamp, there exists such a shortcoming that the shape of the upper tool is restricted.

SUMMARY OF THE INVENTION

With these problems in mind, therefore, it is the primary object of the present invention to provide an upper tool removably attachable to the upper tool holder device, by which the upper tool can be exchanged easily, without dropping the upper tool from the tool holder device, even when the upper tool is released from clamping.

To achieve the above-mentioned object, the present invention provides an upper tool for a press brake which comprises push actuating means for actuating upward an actuated member movable up and down, in a clamping force increasing mechanism such that an upper tool clamping force can be increased gradually when the actuated member mounted on an upper holder device of the press brake is moved upward.

Preferably, the push actuating means is a lower surface of an engagement groove portion extending horizontally and formed in any of a front or rear surface of the upper tool. Further, the push actuating means is a lower surface of an engagement groove portion extending horizontally and formed in any of front and rear surfaces of the upper tool, an upper surface of the engagement groove portion being engageable with a part of the actuated member. Further, the push actuating means is a lower surface of an engagement groove portion extending horizontally and formed in any of front and rear surfaces of the upper tool, the engagement groove portion being formed between a vertical position roughly the same as a holder contact surface formed at a shoulder portion of the upper tool and another vertical position slightly lower than an upper end of the upper tool.

Further, the present invention provides an upper tool for a press brake, which comprises push actuating means for actuating upward an actuated member movable up and down, in a clamping force increasing mechanism such that an upper tool clamping force can be increased gradually when the actuated member mounted on an upper holder device of the press brake is moved upward, said push actuating means being a lower surface of an engagement groove portion rectangular in cross section and formed in any of front and rear surfaces of the upper tool, the upper surface of said engagement groove portion being engageable with a projecting portion rectangular in cross section of the actuated member, and a vertical dimension of the rectangular projecting portion of the actuated member being determined to be slightly larger than that of the engagement groove portion.

In the upper tool for a press brake according to the present invention, when the actuated member of the upper tool holder device is pushed upward by the push actuating means of the upper tool for a press brake relative to the upper tool holder device, since the clamping force increases gradually by the clamping force increasing mechanism, it is possible to clamp the upper tool securely. Accordingly, the upper tool can be mounted to the upper tool holder device easily and securely without use of any tool.

In another preferred embodiment, the present invention provides an upper tool for a press brake removably attached between an support plate provided at a lower portion of a holder body of an upper tool holder device mounted on an upper table of the press brake and an upper tool clamp pivotally attached to the upper holder body so as to push the upper tool against the support plate, wherein the upper tool is formed with: a contact surface brought into tight contact with a lower surface of the support plate; a slide surface brought into slidable contact with any of front and rear surfaces of the support plate; a wedge pushing-up portion for pushing upward a wedge-shaped member provided movably up and down at a lower portion of the upper tool clamp, in order to increase an upper tool clamping force by the upper tool clamp when the upper tool is moved upward relative to the support plate so that the contact surface of the upper tool can be brought into tight contact with the lower surface of the support plate; and a processing portion for processing work in cooperation with a lower tool.

Further, the wedge pushing-up portion is a lower surface formed in an engagement groove portion formed in the upper tool so as to be engageable with and disengageable from an engagement projecting portion of the wedge-shaped member. Further, the engagement groove portion is formed with an upper engagement surface engageable with an upper surface of the engagement projecting portion of the wedge-shaped member for prevention of the upper tool from being dropped from the upper tool holder device. Further, the wedge pushing-up portion is an upper surface formed in an engagement projecting portion formed in the upper tool so as to be engageable with and disengageable from an engagement groove portion formed in the wedge-shaped member.

In other preferred embodiment, the present invention provides an upper tool for a press brake removably attached between an support plate provided at a lower portion of a holder body of an upper tool holder device mounted on an upper table of the press brake and an upper tool clamp pivotally attached to the upper holder body so as to push the upper tool against the support plate, wherein the upper tool is formed with: a contact surface brought into tight contact with a lower surface of the support plate; a slide surface brought into slidable contact with any of front and rear surfaces of the support plate; a wedge pushing-up portion for pushing upward a wedge-shaped member provided movably up and down at a lower portion of the upper tool clamp in order to increase an upper tool clamping force by the upper tool clamp when the upper tool is moved upward relative to the support plate so that the contact surface of the upper tool can be brought into tight contact with the lower surface of the support plate; and a processing portion for processing a workpiece in cooperation with a lower tool, and wherein under the condition that the wedge pushing-up portion is brought into loose contact with the wedge-shaped member to push the wedge-shaped member upward, a space H between the lower end surface of the support plate and the contact surface of the upper tool is given by an expression as follows:

$$H=(B^2\cdot P)/(A^2\cdot K\cdot \tan\theta)$$

where: A denotes a dimension between a pivotal center of the upper tool clamp and an elastic member for pushing the upper tool clamp; B denotes an average dimension between the same pivotal center and a push actuating portion at which the upper tool clamp pushes the upper tool against the support plate via the wedge-shaped member; P denotes a pushing force for pushing the upper tool against the support plate; K denotes the elastic modulus of the elastic member; and θ denotes an inclination angle of the wedge-shaped member.

In the upper tool for a press brake according to the present invention, the upper portion of the upper tool is pinched between the support plate of the upper tool holder device and the pivotal upper tool clamp; the engagement groove portion formed in the upper tool is engaged with the engagement projecting portion of the wedge-shaped member provided movably up and down at the lower portion of the upper tool clamp; and the upper tool is moved upward relative to the support plate to move upward the wedge-shaped member by the wedge pushing-up portion formed at the lower surface of the engagement groove portion of the upper tool. Under these conditions, since the space between the lower portion of the upper tool clamp and the support plate is widened by the wedge-shaped member, the clamping force increases gradually by an elastic force of the elastic member, with the result that it is possible to clamp the upper tool securely.

When the above-mentioned clamping force is released, since the upper surface of the engagement projecting portion of the wedge-shaped member is engaged with the upper surface of the engagement groove portion of the upper tool, it is possible to prevent the upper tool from being dropped from the upper tool holder device, with the result that the upper tool can be attached to or removed from the upper tool holder device easily and safely without use of any tool.

DETAILED DESCRIPTION OF THE PREFERRED EMBODIMENTS

Figure 1:
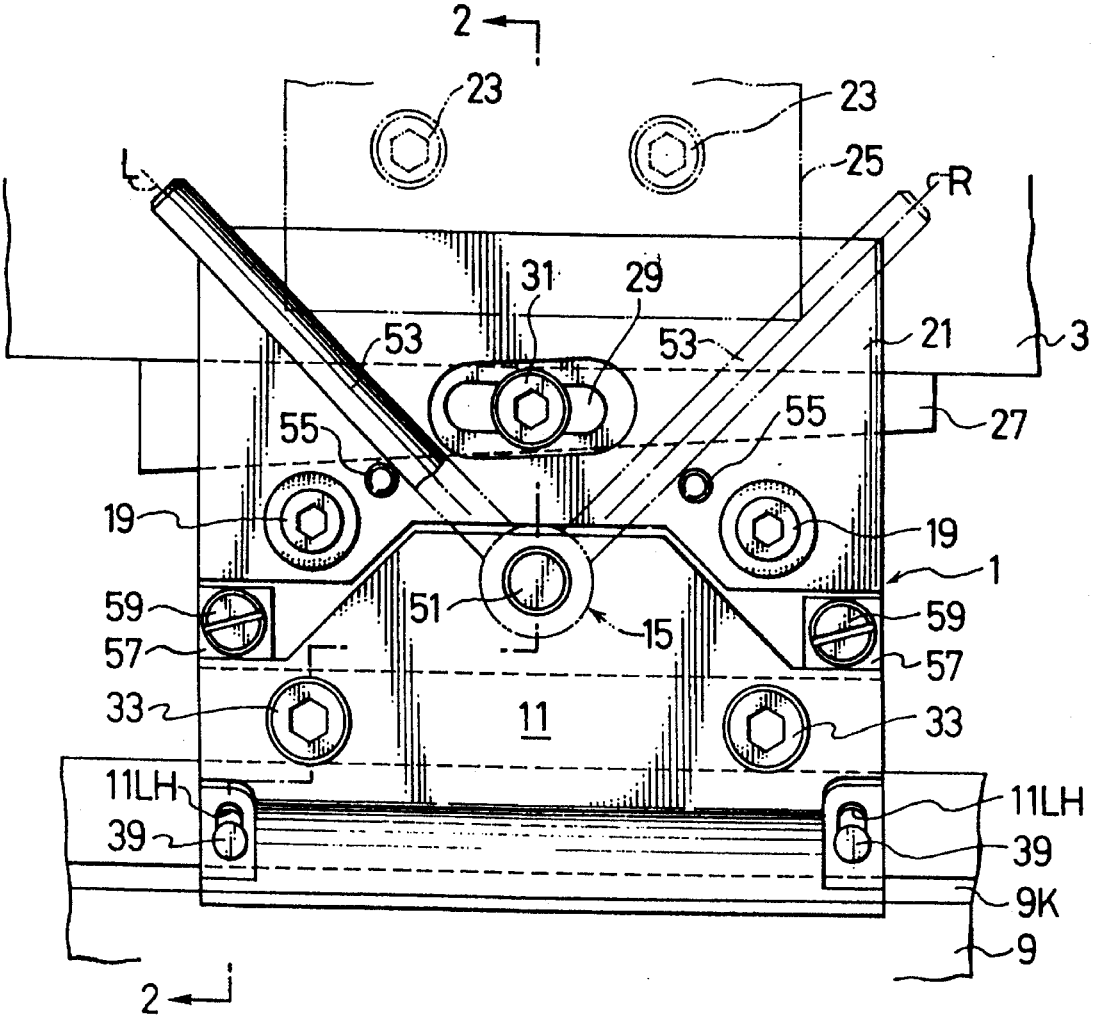
FIG. 1 is a front view showing an embodiment of the upper tool holder device according to the present invention.

To facilitate understanding of the present invention, the overall construction of the upper tool holder device 1 to which the present invention is applied will be described in detail hereinbelow.

The upper tool holder device 1 is removably attached to the lower portion of an upper table 3 of a press brake (not shown). The upper tool holder device 1 is provided with a holder body 5 removably attached to the upper table 3, an upper tool clamp 11 pivotally attached to the holder body 5 to push and fix an upper portion 9U of an upper tool 9 against and to a support plate 7 formed integrally with the lower portion of the holder body 5, a clamping force adjusting mechanism 13 for adjusting the clamping force to the upper tool clamp 11, a clamp releasing mechanism 15 for releasing the upper tool 9 clamped by the upper tool clamp 11, and a wedge-shaped member 17 (actuated member) movable up and down relative to the lower portion of the upper clamp 11 and formed with an engagement projecting portion 17K engageable with an engagement groove portion 9K (push actuating means) formed in the upper tool 9.

In more detail, the holder body 5 is formed with an upper block portion 5B having a thick wall extending in the front and rear direction (the right and left direction in FIG. 2) and a support plate 7 having a thin wall extending in the same direction and formed integral with the upper block portion 5B. Further, a mounting plate 21 is attached onto the front surface (on the left side surface in FIG. 2) of the upper block 5B of the holder body 5 with a plurality (two) of bolts 19 (see FIG. 1) so as to project upward away from the upper end portion of the holder body 5.

Therefore, when the mounting plate 21 is brought into contact with the lower front surface portion of the upper table 3 and further a clamp jaw 25 is fastened with two fastening bolts 23 screwed into the upper table 3, since the upper mounting plate 21 can be pressed against the upper table 3, it is possible to mount the holder body 5 onto the upper table 3.

In order to adjust the vertical position of the holder body 5 relative to the upper table 3, a wedge member 27 extending horizontally (see FIG. 1) is interposed between the upper surface of the holder body 5 and the lower surface of the upper table 3. A fixing bolt 31 is passed through a slot 29 formed in the mounting plate 21 so as to extend in the horizontal direction, and screwed into the wedge member 27 (see FIG. 2).

In the above-mentioned structure, under the condition that the clamp jaw 25 is fastened slightly to such an extent that the holder body 5 will not fall and in addition the fixing bolt 31 is unfastened, when the wedge member 27 is moved in the right and left direction in FIG. 1, it is possible to finely adjust the vertical position of the holder body 5 relative to the upper table 3.

Figure 2:
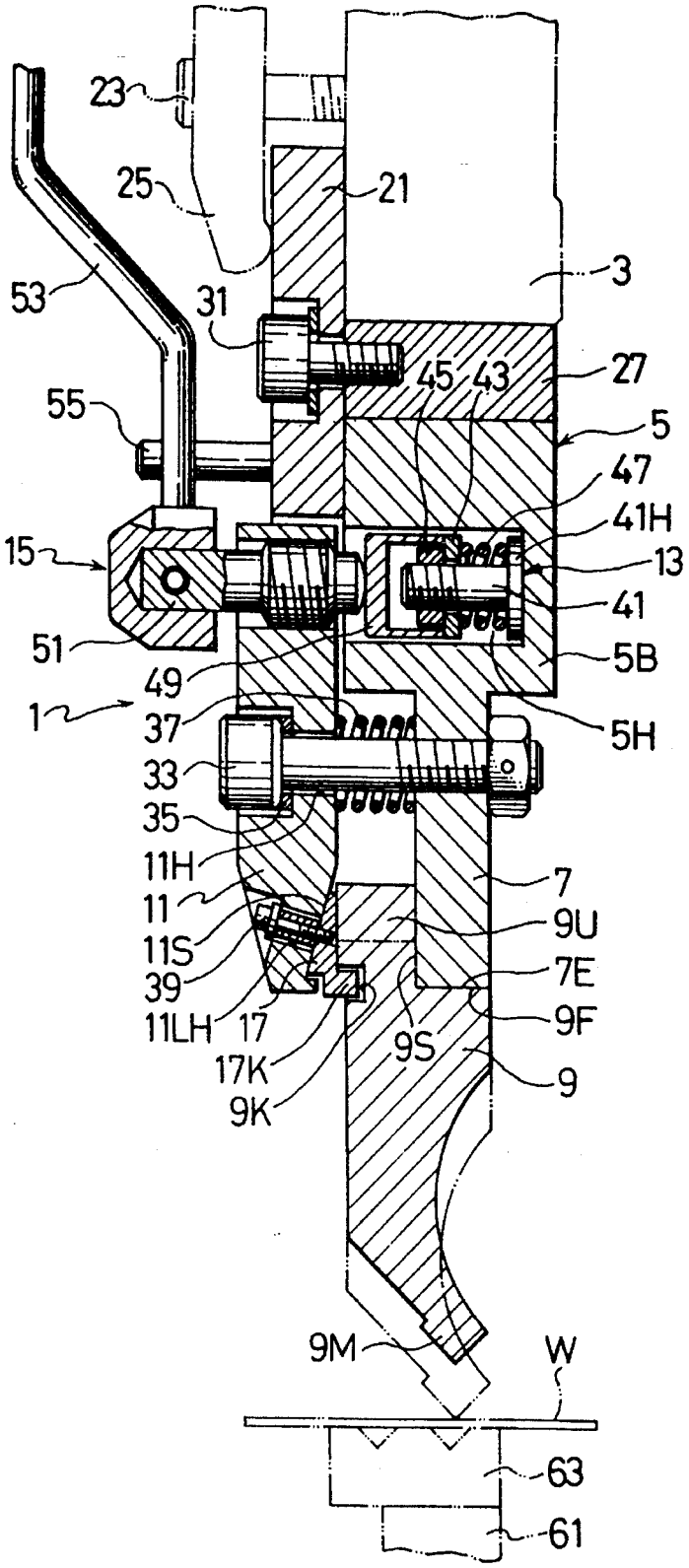
FIG. 2 is a cross-sectional view taken along the line 2—2 shown in FIG. 1.

The above-mentioned upper tool clamp 11 is a plate member having a width (in the right and left direction in FIG. 1) roughly the same as that of the holder body 5, and pivotally attached to the holder body 5 so as to fasten and fix the upper portion 9U of the upper tool 9 between the upper tool clamp 11 and the support plate 7 (as shown in FIG. 2) and to the support plate 7.

In more detail, the upper clamp 11 is supported so as to be pivotal in the front and rear direction by a plurality of mounting bolts 33 passing through a plurality (two) of through holes 11H formed at roughly the vertically middle portion of the upper tool clamp 11 and fixedly fastened toward the support plate 7 In the horizontal direction. To facilitate the pivotal motion of the upper tool clamp 11, a spherical washer 35 is interposed between each head of the mounting bolts 33 and the upper tool clamp 11, as shown in FIG. 2. Further, two coil springs 37 are elastically interposed between the upper tool clamp 11 and the support plate 7 so as to be urged away from each other.

The upper tool clamp 11 is formed with an inclined surface 11S at the lower portion thereof, whose upper end portion is inclined toward the support plate 7. In contact with this inclined surface 11S, the wedge-shaped member (actuated member) 17 is disposed so as to be movable up and down relative to the inclined surface 11S.

In more detail, the upper tool clamp 11 is formed with two slots 11LH extending in the vertical direction on the left and right sides at the lower end portion thereof. Further, two mounting bolts 39 passing through these slots 11LH, respectively are screwed into the wedge-shaped member (actuated member) 17, so that the wedge-shaped member 17 can be attached to the upper tool clamp 11 so as to be movable up and down, because the two mounting bolts 29 are movable within the slots 11LH. Further, the wedge-shaped member 17 is formed with the engagement projecting portion 17K at an appropriate position thereof so as to be removably engageable with a horizontal engagement groove portion 9K formed in the upper tool 9.

In other words, since the engagement projecting portion 17K is a projecting portion projecting outward from the wedge-shaped member (actuated member) 17, the cross-sectional shape of the engagement projecting portion 17K is rectangular in shape, as shown in FIG. 2.

Further, the clamping force adjusting mechanism 13 is provided In a horizontal hole 5H formed in the upper block portion 5B of the holder body 5, so as to apply an adjustable clamping force to the upper tool 9 clamped between the upper clamp 11 and the support plate 7.

In more detail, as shown in FIG. 2, the clamping force adjusting mechanism 13 is composed of an adjusting screw 41, a ring member 43 loosely fitted to the adjusting screw 41, a nut member 45 in mesh with the adjusting screw 41 to adjust the position of the ring member 43, and an elastic member 47 such as a spring disposed between a head portion 41H of the adjusting screw 41 and the ring member 43.

In the above-mentioned construction, it is possible to adjust the urging force of the elastic member 47 by adjusting the engagement position of the nut member 45 relative to the adjusting screw 41; that is, by adjusting the compression of the elastic member 47.

In the clamping force adjusting mechanism 13, the head portion 41H of the adjusting screw 41 is in contact with the inner bottom wall portion of the hole 5H, and further a cylindrical push member 49 (into which the nut member 45 is inserted) is in contact with the ring member 43. Further, the end portion of the fastening screw 51 of the clamping force releasing mechanism 15 provided on the upper tool clamp 11 is in contact with the push member 49.

In more detail, the clamp releasing mechanism 15 is composed of the fastening screw 51 passing through and screwed into the upper portion of the upper tool clamp 11 and a lever 53 formed integral with the fastening screw 51.

Accordingly, when the lever 53 is pivoted, it is possible to fasten and unfasten the fastening screw 51 toward and from the cylindrical push member 49. Further, two right and left stopper pins 55 (see FIG. 1) are implanted in the mounting plate 21 to restrict the pivotal motion of the lever 53.

In the above-mentioned construction, as shown in FIG. 2, under the condition that the upper tool 9 is clamped between the support plate 7 of the holder body 5 and the upper clamp 11, when the lever 53 of the clamp releasing mechanism 15 is pivoted clockwise to the rightward position (R) in FIG. 1 to fasten the fastening screw 51, since the elastic member 47 of the clamping force adjusting mechanism 13 is further compressed, the elastic force of the elastic member 47 is increased, so that the upper tool 9 is more strongly fastened and fixed by the upper clamp 11 due to an increased reaction force caused by the elastic force of the elastic member 47.

In contrast with this, when the lever 53 of the clamp releasing mechanism 15 is pivoted counterclockwise to the leftward position (L) In FIG. 1 to unfasten the fastening screw 51, the upper tool 9 is released from the clamping force of the upper tool clamp 11.

As described above, when the lever 53 is pivoted to fasten or unfasten the upper tool 9 through the upper clamp 11, the upper clamp 11 is pivoted clockwise or counterclockwise (leftward or rightward in FIG. 2) about the mounting bolt 33.

In order to guide the pivotal motion of the upper tool clamp 11 and further to restrict the vertical movement of the upper tool clamp 11, as shown in FIG. 1, a plurality of small restriction pieces (or members) 57 are attached to the holder body 5 with bolts 59 so as to be in contact with the upper surface of the upper tool clamp 11. Accordingly, the upper clamp 11 can fasten or fix the upper tool 9 at any predetermined position stably without being moved up and down.

As shown in FIG. 2, the upper tool 9 removably attached to the upper tool holder device 1 constructed as described above is formed with a contact surface 9F brought into contact with a lower end surface 7E of the support plate 7. Further, the upper tool 9 is formed with the upper portion 9U projecting upward from the contact surface 9F and with a slide surface 9S brought into slidable contact with the front surface of the support plate 7. Further, the upper tool 9 is formed with an engage groove portion (push actuating means) 9K on the surface opposite to the slide surface 9S. Further, the upper tool 9 is formed with a workpiece processing portion 9M at the lower end portion thereof to bend a workpiece W in cooperation with a lower tool 63 attached to the lower table 61 of the press brake.

As well understood with reference to FIG. 2, the engagement groove of the engagement groove portion 9K is formed into a rectangular shape in cross section in such a way that the upper surface of the engagement groove portion (push actuating means) 9K serves as an engagement surface engageable with the upper surface of the engagement projecting portion 17K of the wedge-shaped member (actuated member) 17, and further the lower surface thereof parallel to the upper surface thereof serves as a push actuating means or a wedge pushing-up portion for pushing up the lower surface of the engagement projecting portion 17K of the wedge-shaped member 17. Accordingly, the engagement projecting portion 17K of the wedge-shaped member 17 can be engaged with the engagement groove portion 9K of the upper tool 9. Further, the vertical dimension of the engagement groove portion 9K is determined to be slightly larger than that of the engagement projecting portion 17K so that the wedge-shaped member 17 is not moved up and down excessively relative to the upper tool 9.

In the above-mentioned construction, in the case where the upper tool 9 has been removed from the upper tool holder device 1, the upper tool 9 can be attached again to the upper tool holder device 1 as follows:

First, the lever 58 of the clamp releasing mechanism 15 is pivoted clockwise in FIG. 1 to the rightward position (R) to fasten the fastening screw 51. Under these conditions, a space can be maintained between the support plate 7 and the wedge-shaped member 17 attached to the lower portion of the upper tool clamp 11, and the wedge-shaped member 17 is located at the lowermost position due to its weight.

Accordingly, it is possible to insert the upper portion 9U of the upper tool 9 into the space formed between the support plate 7 and the upper clamp 11 in the horizontal direction in such a way that the engagement groove portion 9K (push actuating means) formed in the upper tool 9 is engaged with the engagement projecting portion 17K of the wedge-shaped member 17 (actuated member).

Thereafter, the movable side of the upper and lower tables 3 and 61 of the press brake is moved up and down to engage the upper and lower tools 9 and 63 correctly with each other. In this engagement process of both the upper and lower tools 9 and 63, the upper tool 9 is generally moved upward relative to the holder body 5.

When the upper tool 9 is moved gradually upward relative to the holder body 5 as described above, since the lower surface of the engagement projecting portion 17K of the wedge-shaped member 17 is also moved upward by the lower surface of the engagement groove portion 9K of the upper tool 9, the wedge-shaped member 17 is moved upward together with the upper tool 9. Accordingly, the upper tool clamp 11 is pivoted gradually in the clockwise direction in FIG. 2, so that the elastic member 47 of the clamping force adjusting mechanism 13 is compressed gradually.

Accordingly, when the upper tool 9 is moved upward relative to the support plate 7 so that the contact surface 9F of the upper tool 9 is brought, into contact with the lower end surface 7E of the support plate 7, the upper tool clamp 11 can clamp the upper portion 9U of the upper tool 9 more strongly and tightly due to the increased elastic force of the elastic member 47 of the clamping force adjusting mechanism 13, with the result that it is possible to attach the upper tool 9 easily to the upper tool holder device 1.

In the above-mentioned construction, in the case where the upper tool 9 has been already attached to the upper tool holder device 1, the upper tool 9 can be removed from the upper tool holder device 1 as follows:

First, the lever 53 of the clamp releasing mechanism 15 is pivoted to the leftward position (L) in FIG. 1 to unfasten the fastening screw 51, so that the upper tool 9 is released from the fastening condition by the upper tool clamp 11.

When the upper tool 9 is released from the upper tool clamp 11, both the upper tool 9 and the wedge-shaped member 17 drop to the lowermost position due to their weights, respectively. In this case, since an upper surface of the engagement groove portion 9K of the upper tool 9 is engaged with the engagement projecting portion 17K of the wedge-shaped member 17, it is possible to prevent the upper tool 9 from being further dropped, thus maintaining the safety. Under the condition that the upper tool 9 is released from the clamping condition by the upper tool clamp 11, when the upper tool 9 is moved in the horizontal direction, it is possible to easily remove the upper tool 9 from the upper tool holder device 1.

As understood already, in the upper tool holder device 1 according to the present invention, it is possible to attach and remove the upper tool 9 to and from the upper tool holder device 1 easily, without use of any tool, in spite of the simple construction.

Further, in the embodiment of the present invention, the structure is such that when the lower surface of the engagement groove portion 9K (push actuating means) of the upper tool 9 pushes upward the engagement projecting portion 17K of the wedge-shaped member (actuated member) 17, the clamping force (push force) of the upper tool clamp 11 against the support plate 7 increases gradually with increasing upward movement of the wedge-shaped member 17. Therefore, the wedge-shaped member 17, the upper clamp 11 and the clamp force adjusting mechanism 13, etc. construct a sort of clamp force increasing mechanism for increasing the clamping force gradually when the wedge-shaped member 17 (which serves as an actuated member) is moved upward relative to the support plate 7.

As a part of the above-mentioned clamping force increasing mechanism, there is provided a clamping force adjusting mechanism 13 including the elastic member 47. In this embodiment, however, it is also possible to adopt a hydraulic cylinder filled with a compressive fluid (e.g., gas) instead of the clamping force adjusting mechanism 13. Further, it is also possible to construct the upper tool clamp 11 itself by a leaf spring without use of the clamping force adjusting mechanism 13. In this case, the elastic deformation of the upper tool clamp 11 itself is used to generate the clamping force. In other words, the clamping force increasing mechanism of the upper tool holder device can be constructed in various ways.

Figure 3:
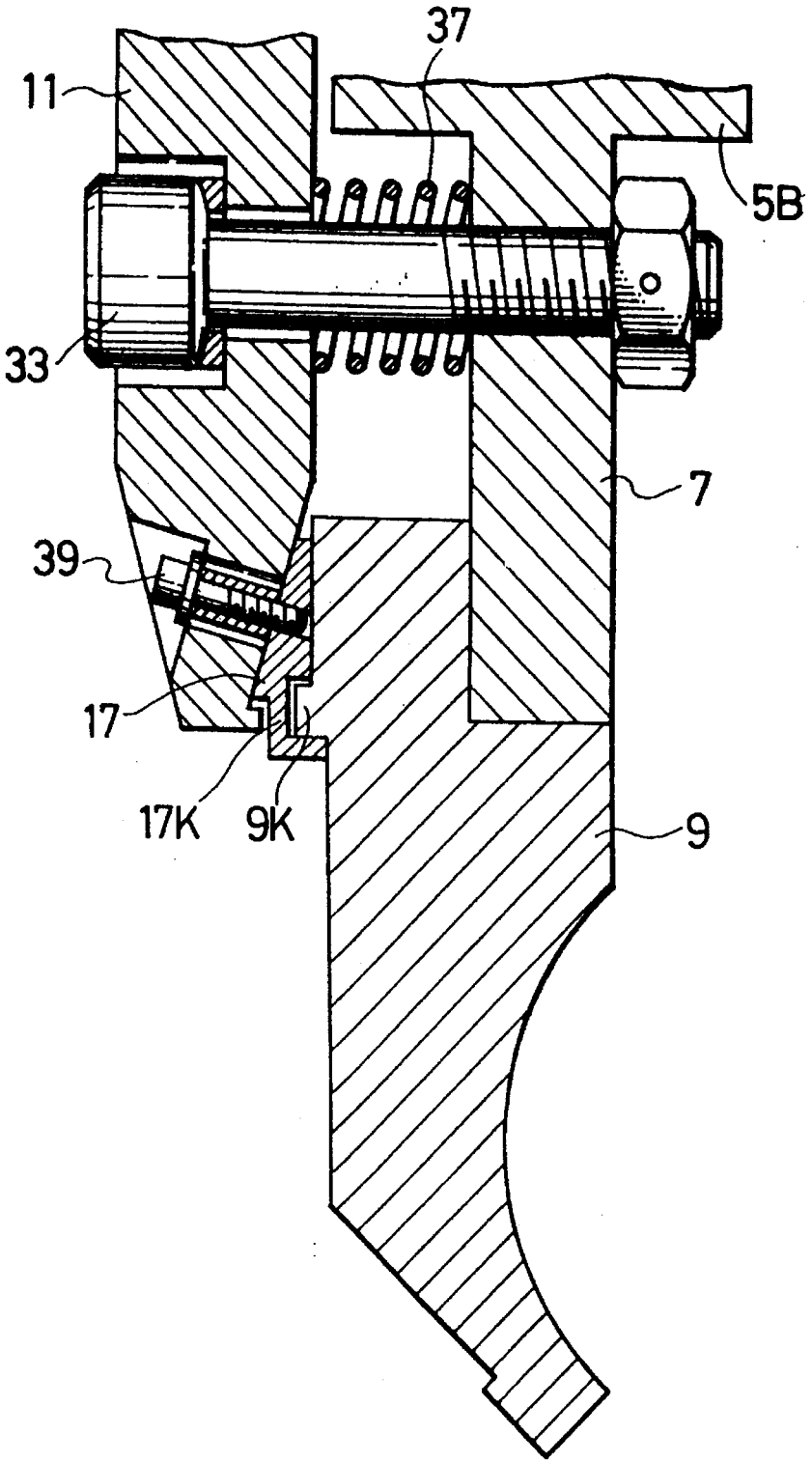
FIG. 3 is a cross-sectional view showing the essential portion of a second embodiment of the upper tool holder device according to the present invention.

FIG. 3 shows a second embodiment of the upper tool holder device 1 according to the present invention, in which the wedge-shaped member (actuated member) 17 is formed with an engagement groove portion 17K, and the upper tool 9 is formed with an engagement projecting portion 9K (push actuating means) so as to be engageable with the engagement groove portion 17K of the wedge-shaped member 17. In other words, the wedge-shaped member 17 is pushed upward by the engagement projecting portion 9K of the upper tool 9. The construction and the function of the second embodiment except above are the same as with the case of the first embodiment, and whereby the same effect as in the first embodiment can be obtained.

Figure 4:
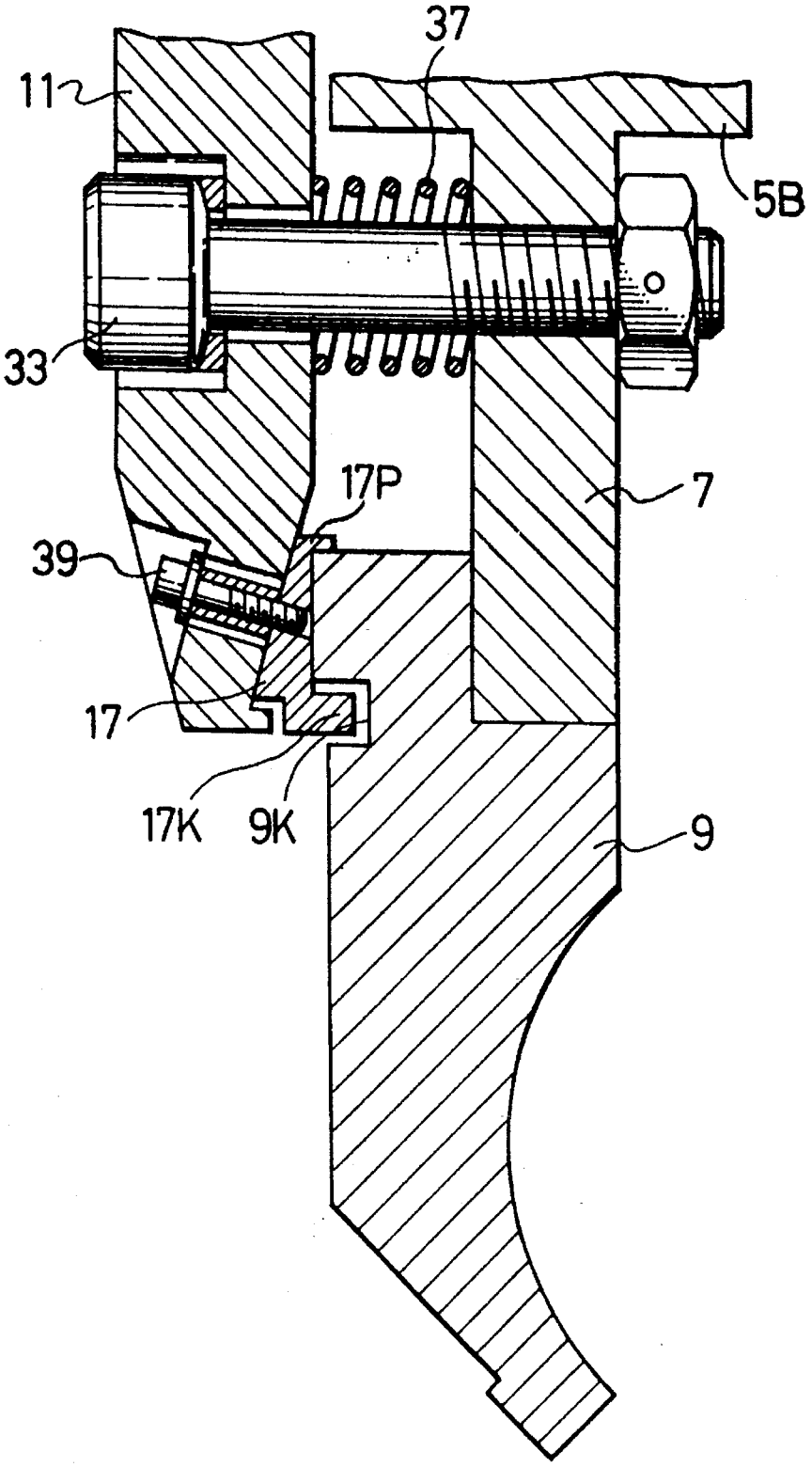
FIG. 4 is a cross-sectional view showing the essential portion of a third embodiment of the upper tool holder device according to the present invention.

FIG. 4 shows a third embodiment of the upper tool holder device 1 according to the present invention, in which the wedge-shaped member (actuated member) 17 is additionally formed with an upper engagement projecting portion 17P. By bringing this engagement projecting portion 17P into contact with the upper surface of the upper tool 9, the wedge-shaped member 17 is pushed upward by the upper surface of the upper tool 9. The construction and the function of the third embodiment except above are the same as with the case of the first and second embodiments, and whereby the same effect as in the first and second embodiments can be obtained.

Figure 5:
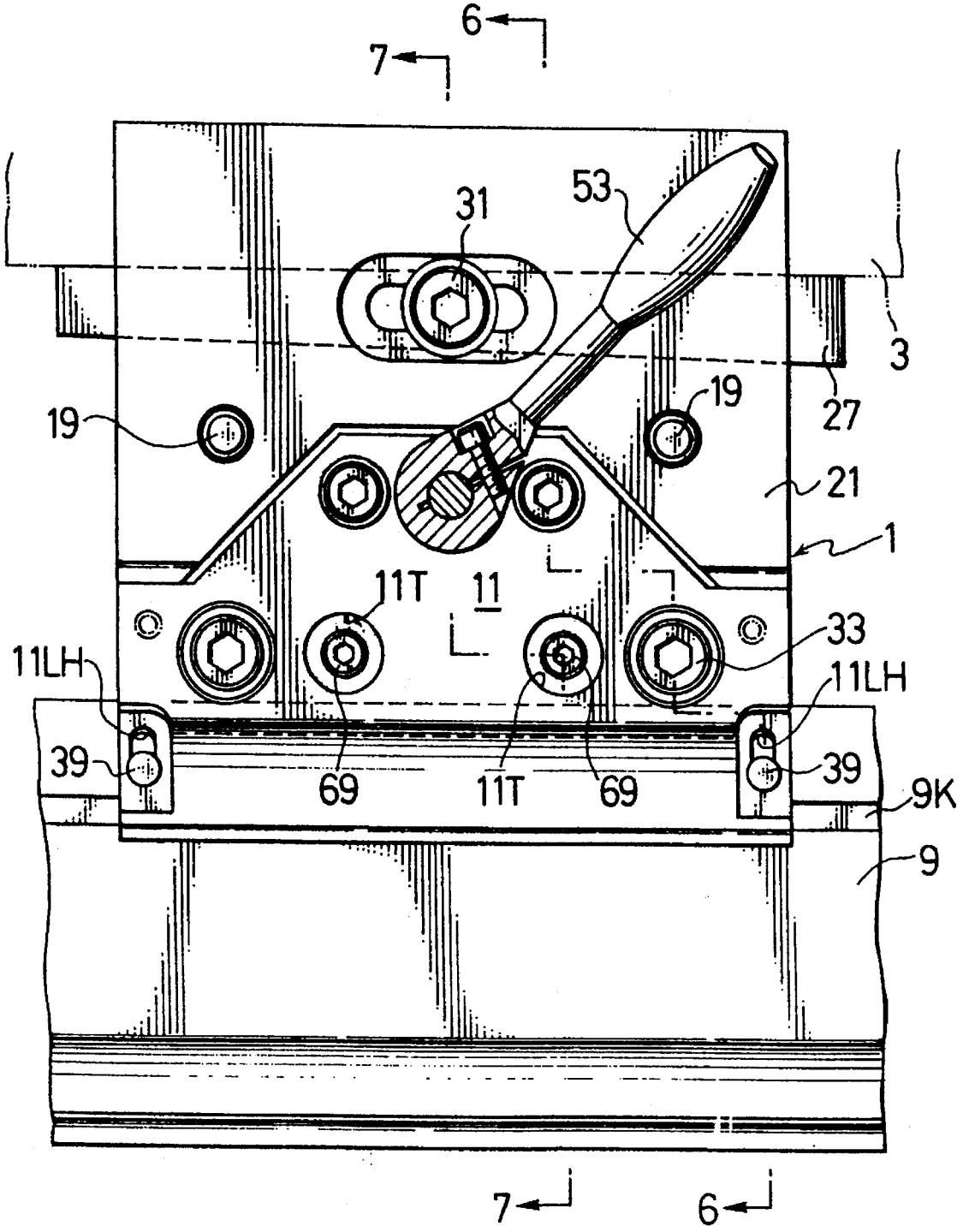
FIG. 5 is a front view showing a fourth embodiment of the upper tool holder device according to the present invention.
Figure 6:
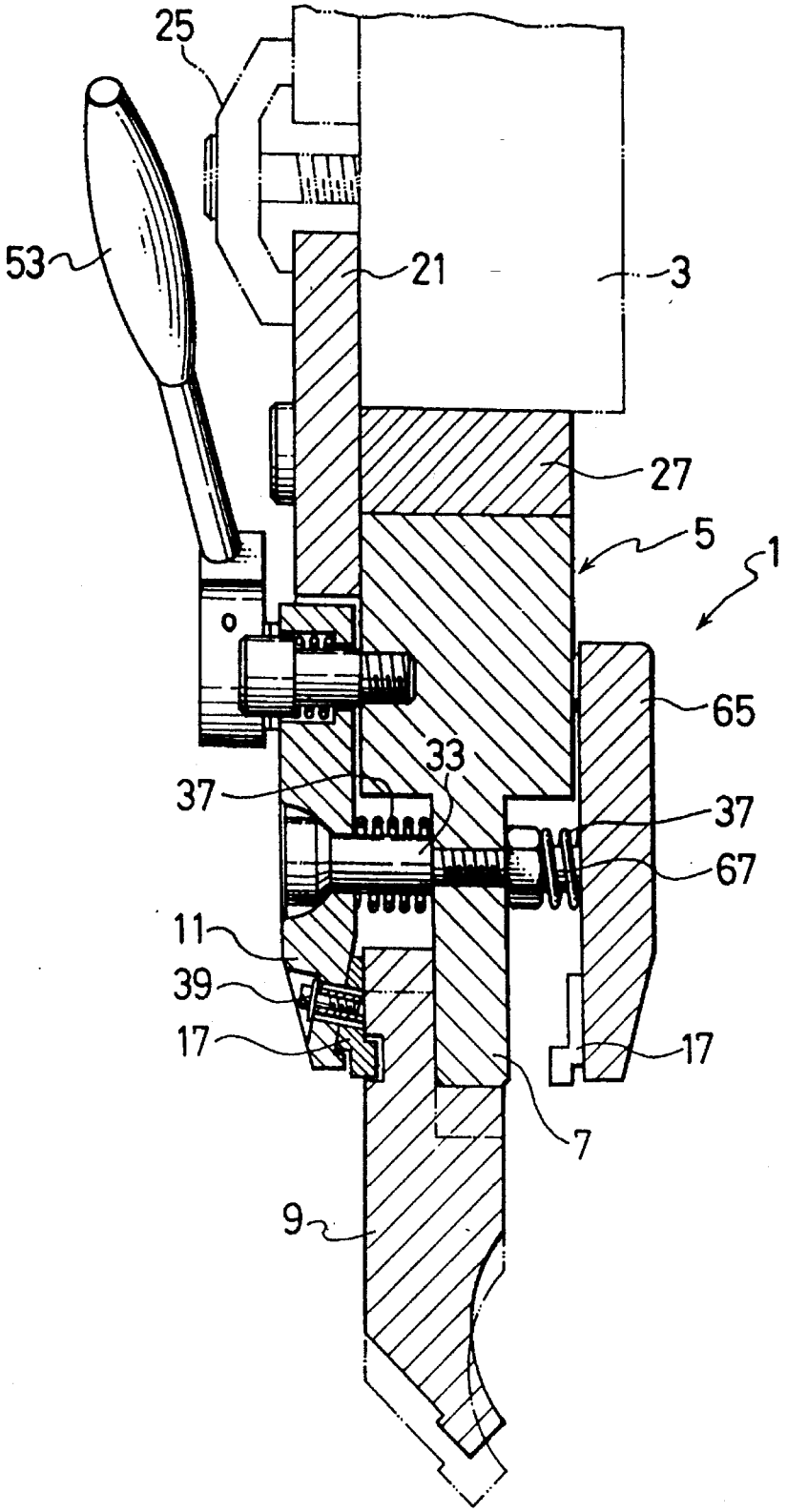
FIG. 6 is a cross-sectional view taken along the line 6—6 shown in FIG. 5.
Figure 7:
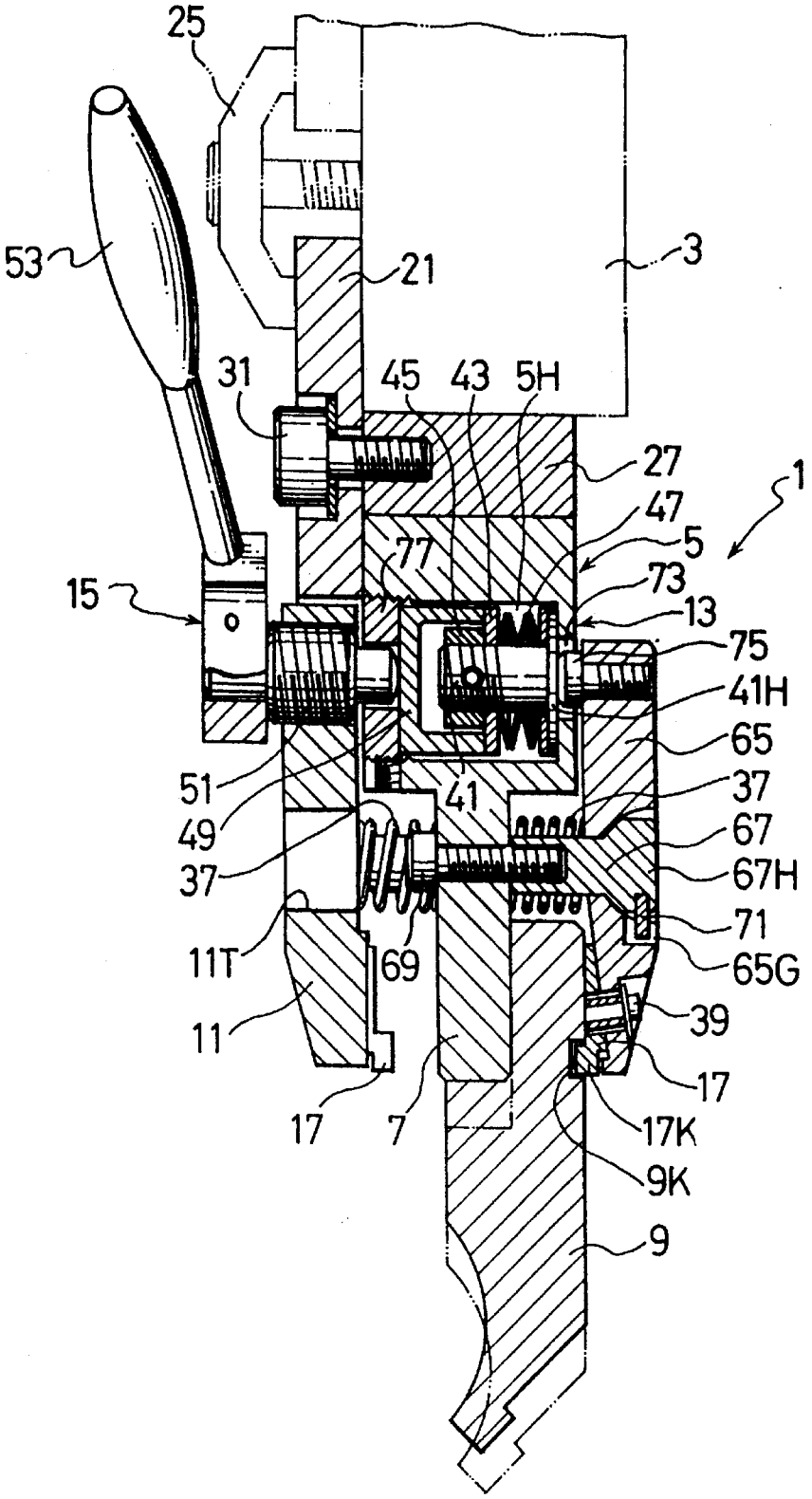
FIG. 7 is a cross-sectional view taken along the line 7—7 shown in FIG. 5.

FIGS. 5 to 7 show the fourth embodiment of the upper tool holder device 1 according to the present invention, in which both the surfaces of the upper tool 9 can be reversed relative to each other and further an additional upper tool 9 can be attached to the rear surface side of the support plate 7 in cooperation with another rear side upper tool clamp 65. Accordingly, the same reference numerals have been retained for the similar parts or elements which have the same functions as with tile case of the first embodiment, and only the points different from the first embodiment will be described hereinbelow, without repeating the similar detailed description thereof.

In order to attach the upper tool 9 onto the rear surface side of the support plate 7, the rear side upper tool clamp 65 is provided on the rear side of the support plate 7.

In more detail, as shown in FIG. 7, a stud 67 formed with a semi-spherical head 67H is provided horizontally by use of a mounting bolt 69 on the rear surface of the support plate 7 of the holder body 5. The rear side upper tool clamp 65 is pivotally supported by this stud 67.

To pivot the mounting bolt 69, a tool hole 11T is formed in the front side upper tool clamp 11. Further, a rotation-stop pin 71 is attached to the head portion 67H of the stud 67 so as to be engaged with a groove 65G formed in the rear side upper tool clamp 65. Therefore, even when the mounting bolt 69 is rotated, the stud 67 will not be rotated.

To use in common the clamping force adjusting mechanism 13 for both the front side upper tool clamp 11 and the rear side upper tool clamp 65, a small-diameter hole 73 is formed In the bottom wall portion of the hole 5H of the holder body 5. Further, a contact member 75 mounted on the upper portion of the rear side upper tool clamp 65 is passed through this small-diameter hole 73 and brought into contact with the head portion 41H of the adjusting screw 41.

Further, a ring nut 77 is screwed into the hole 5H on the left side (in FIG. 2) to restrict the movement of the push member 49 of the clamping force adjusting mechanism 13.

In the above-mentioned structure, when the mounting bolt 69 screwed into the stud 67 is fastened, it is possible to push and fix the upper tool 9 against the rear side surface of the support plate 7 with the rear side upper tool clamp 65. In contrast with this, when the mounting bolt 69 is unfastened, the upper tool 9 is released from the rear side upper tool clamp 65.

Further, when the upper tool clamp 11 is kept immovable under the condition that an appropriate member is interposed between the front side upper tool clamp 11 and the support plate 7, it is possible to fasten and unfasten the upper tool 9 by the rear-side upper tool clamp 65 with the use of the lever 53.

In summary, In the fourth embodiment, it is possible to selectively attach the upper tool 9 reversed in the front and rear direction to the support plate 7 according to the bending shape of the workpiece W. Further, the upper tool 9 can be attached to and removed from the upper tool holder device 1 easily for tool exchange.

As described above, in the upper tool holder device 1 and the upper tool 9 according to the present invention, it is possible to attach and remove the upper tool 9 to and from the upper tool holder device 1 easily in spite of the simple construction, without dropping the upper tool 9 even when the upper tool 9 is released from the upper tool holder device 1, thus improving the safety of the upper tool exchange process.

As described above, in the upper tool holder device 1 of the present invention, the upper tool 9 can be moved upward relative to the support plate 7 of the tool holder device 1, and the tool clamping force by the upper tool clamp 11 can be increased gradually when the wedge-shaped member (actuated member) 17 is pushed upward. Therefore, when the contact surface 9F of the upper tool 9 is brought into contact with the lower end surface 7E of the support plate 7, it is possible to obtain a sufficiently large clamping force.

Figure 8:
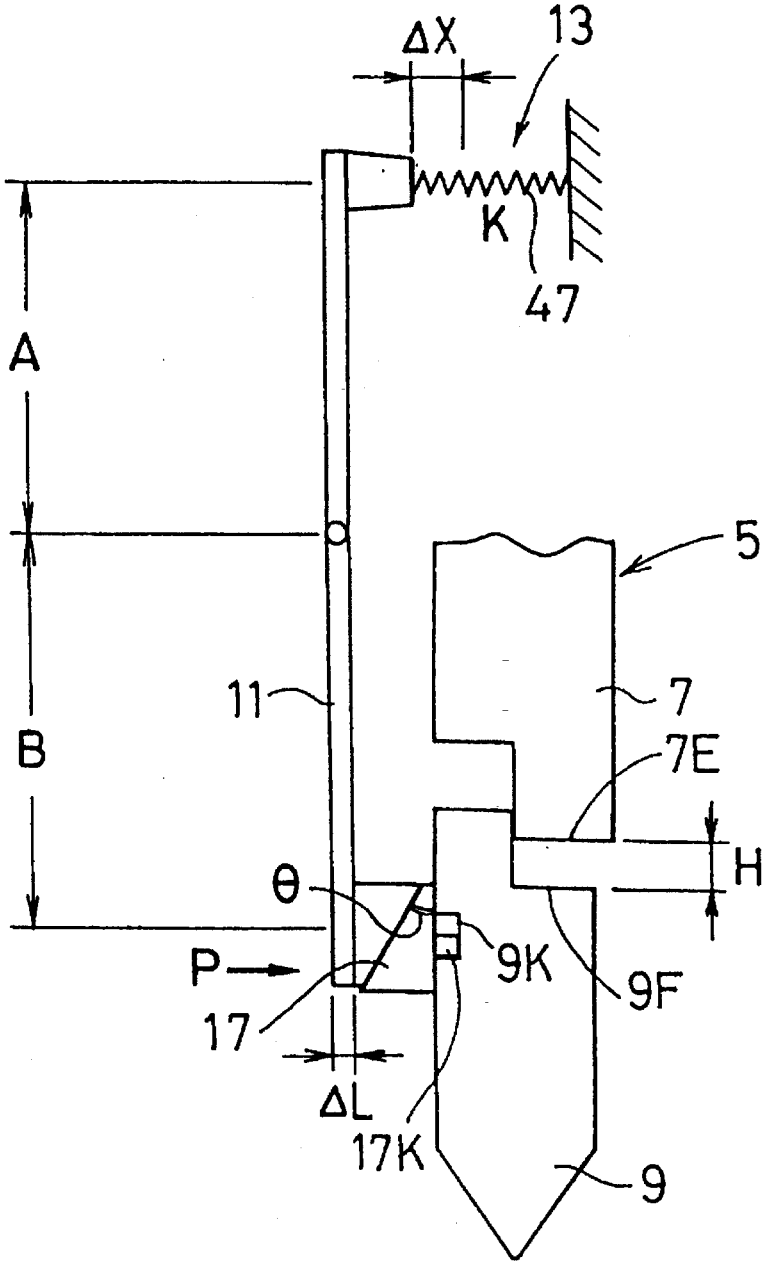
FIG. 8 is an illustration showing the relationship between the upper tool holder device and the upper tool according to the present invention.

With reference to FIG. 8, the dimensional relationship of the tool clamping elements will be explained in further detail below. Under the condition that the lower surface of the engagement projecting portion 17K of the wedge-shaped member (actuated member) 17 is brought into a faint contact with the lower surface of the engagement groove portion (push actuating means) 9K formed in the upper tool 9 as the wedge pushing-up portion, it is preferable that the space H between the lower end surface 7E of the support plate 7 and the contact surface 9F of the upper tool 9 is determined as expressed below:

$$H=(B^2\cdot P)/(A^2\cdot K\cdot \tan\theta)$$

where:

A denotes a dimension between the pivotal center of the upper tool clamp 11 and the elastic means 47 of the clamping force adjusting mechanism 13 for pushing the upper tool clamp 11; B denotes an average dimension between the same pivotal center and the push actuating portion at which the upper tool clamp 11 pushes the upper tool 9 against the support plate 7 via the wedge-shaped member 17; P denotes a pushing force for pushing the upper tool 9 against the support plate 7; K denotes the elastic modulus of the elastic means 47; and θ denotes an inclination angle of the wedge-shaped member 17.

As shown in FIG. 8, when the upper tool 9 is moved upward relative to the support plate 7, since the lower portion of the upper tool clamp 11 is displaced by ΔL and simultaneously the upper portion thereof is displaced by ΔX, the elastic member 47 is compressed, so that a clamping force can be increased.

Here, however, if the dimension H is smaller than that as expressed by the above formula, when the upper tool 9 is moved slightly upward, since the contact surface 9F of the upper tool 9 is brought into contact with the lower end surface 7E of the support plate 7, a sufficient clamping force cannot be obtained. As a result, there exists an undesirable possibility that the upper tool 9 may drop.

In contrast with this, if the dimension H is larger than that as expressed by the above formula, when the contact surface 9F of the upper tool 9 is brought into contact with the lower end surface 7E of the support plate 7, the displacement of the elastic member 47 increases beyond the above-mentioned value ΔX. Therefore, although a large clamping force can be obtained, when the upper tool 9 is required from being released from the clamping force by use of the lever 53, a large releasing force is required, with the result that there exists an undesirable possibility that the upper tool 9 cannot be attached to or removed from the upper tool holder device 1.

Figure 9:
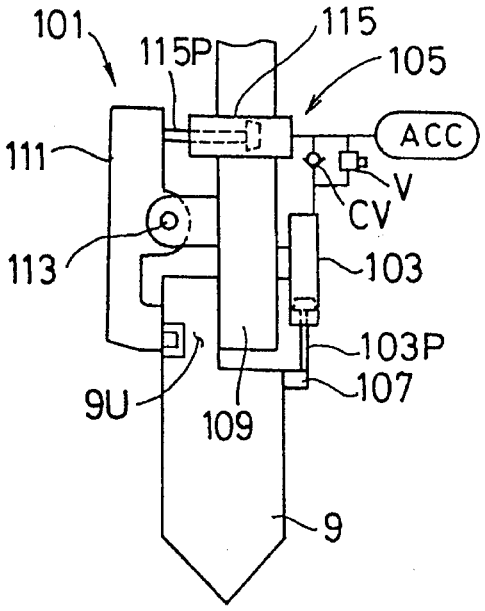
FIG. 9 is an illustration showing a fifth embodiment of the upper tool holder device and the upper tool according to the present invention.

FIG. 9 shows a fifth embodiment of the upper tool holder device 101 and the upper tool 9 according to the present invention.

In this embodiment, an upper tool holder device 101 is provided with a work cylinder 103. Further, the upper tool 9 is provided with a push actuating member (means) 107 for pushing upward an actuated rod (actuated member) 103P of the work cylinder 103. When this work cylinder 103 is moved upward, it is possible to obtain a clamping force increasing mechanism 105 for increasing the tool clamping force gradually.

In more detail, an upper clamp 111 is pivotally supported by a support plate 109 via a pin 113. This upper clamp 111 pushes and fixes the upper portion 9U of the upper tool 9 against and to the support plate 109 of the upper tool holder device 101.

At the upper portion of the upper tool clamp 111, a piston rod 115P is provided. The end of this piston rod 115P is reciprocatingly inserted into a clamp cylinder 115 attached to the support plate 109. The cylinder 115 is linked with the work cylinder 103 provided with the actuated rod 103P via a hydraulic circuit composed of a check valve CV, an open/close valve V, and an accumulator ACC.

Therefore, in this embodiment, after the upper portion 9U of the upper tool 9 has been located between the support plate 109 and the upper clamp 11, when the actuated rod (actuated member) 103P is pushed upward by the push actuating member (means) 107 of the upper tool 9, since the working fluid within the work cylinder 103 is supplied to the clamp cylinder 115 through the check valve CV, so that the piston rod 115P projects to pivot the upper clamp in the counterclockwise direction. Consequently, the upper portion 9U of the upper tool 9 can be pushed against and fixed to the support plate 109.

Figure 10:
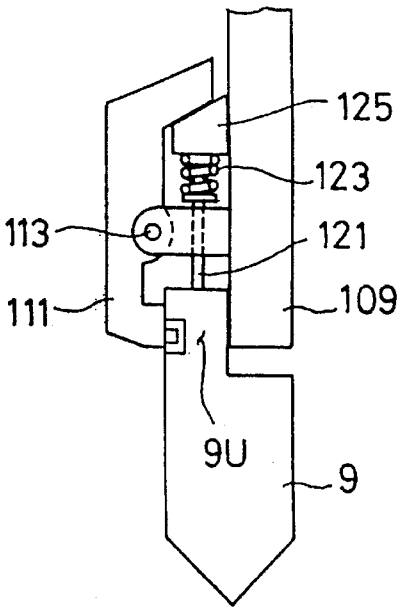
FIG. 10 is an illustration showing a sixth embodiment of the upper tool holder device and the upper tool according to the present invention.

FIG. 10 shows a sixth embodiment of the present invention. In this embodiment, the upper surface of the upper portion 9U of the upper tool 9 is used as a push actuating means. That is, when an actuated (rod) member 121 (movable up and down) is pushed upward by this push actuating means (the upper surface) of the upper tool 9, since an upper wedge member 125 is pushed upward via an elastic member 123 disposed on the upper portion of the actuated rod member 121, the upper clamp 111 is pivoted in the counterclockwise direction in FIG. 10, so that the upper tool 9 can be pushed against and fixed to the support plate 109.

As described above, the upper tool for a press brake according to the present invention comprises push actuating means (9K, 107, 9U) for actuating upward an actuated member (17, 103P, 121) movable up and down, in a clamping force increasing mechanism such that an upper tool clamping force can be increased gradually when the actuated member (17, 103P, 121) mounted on an upper holder device (1) of the press brake is moved upward. Therefore, it is possible to clamp the upper tool securely to the upper tool holder device without use of any tool. For this purpose, the upper tool is formed with only the push actuating means for pushing upward the actuated member. In other words, it is unnecessary to form tile upper tool into a special shape.

Further, the push actuating means is a lower surface of an engagement groove portion (9K) extending horizontally and formed in any of a front or rear surface of the upper tool (9). Therefore, the shape of the push actuating means is simple.

Further, the push actuating means is a lower surface of an engagement groove portion (9K) extending horizontally and formed in any of front and rear surfaces of the upper tool (9), and an upper surface of the engagement groove portion (9K) is engageable with a part of the actuated member (17). Therefore, the upper and lower surfaces of the engage groove portion formed in the upper tool can be utilized effectively.

Further, the push actuating means is a lower surface of an engagement groove portion (9K) extending horizontally and formed in any of front and rear surfaces of the upper tool (9), and the engagement groove portion (9K) is formed between a vertical position roughly the same as a holder contact surface (9F) formed at a shoulder portion of the upper tool (9) and another vertical position slightly lower than an upper end of the upper tool. Therefore, when the upper tool is clamped between the upper tool clamp and the support plate, no moment for pivoting the upper tool will be generated, so that it is possible to fix and clamp the upper tool more securely.

Further, the upper tool for a press brake according to the present invention comprises push actuating means (9K) for actuating upward an actuated member (17) movable up and down, in a clamping force increasing mechanism such that an upper tool clamping force can be increased gradually when the actuated member (17) mounted on an upper holder device (1) of the press brake is moved upward. The push actuating means (9K) is a lower surface of an engagement groove portion (9K) rectangular in cross section and formed in any of front and rear surfaces of the upper tool (9); the upper surface of the engagement groove portion (9K) is engageable with an engagement projecting portion (17K) rectangular in cross section of the actuated member (17); and a vertical dimension of the rectangular engagement projecting portion (17k) of the actuated member is determined to be slightly larger than that of the engagement groove portion. Therefore, the upper tool can be removably attached to the upper tool holder device without applying an excessive vertical movement of the upper tool relative to the upper tool holder device, with the result that the upper tool can be exchanged stably.

Further, the present invention provides an upper tool for a press brake removably attached between an support plate (7) provided at a lower portion of a holder body (5) of an upper tool holder device (1) mounted on an upper table (3) of the press brake and an upper tool clamp (11) pivotally attached to the upper holder body (5) so as to push the upper tool (9) against the support plate (7), wherein the upper tool is formed with: a contact surface (9F) brought into tight contact with a lower surface of the support plate (7); a slide surface (9S) brought into slidable contact with any of front and rear surfaces of the support plate; a wedge pushing-up portion (9K) for pushing upward a wedge-shaped member (17) provided movably up and down at a lower portion of the upper tool clamp (11), in order to increase an upper tool clamping force by the upper tool clamp (11) when the upper tool (9) is moved upward relative to the support plate (7) so that the contact surface (9F) of the upper tool can be brought into tight contact with the lower surface of the support plate; and a processing portion (9M) for processing work in cooperation with a lower tool (63).

The wedge pushing-up portion (9K) is a lower surface formed in an engagement groove portion (9K) formed in the upper tool so as to be engageable with and disengageable from an engagement projecting portion (17K) of the wedge-shaped member (17). Further, the engagement groove portion (9K) is formed with an upper engagement surface engageable with an upper surface of the engagement projecting portion (17K) of the wedge-shaped member (17) for prevention of the upper tool from being dropped from the upper tool holder device (1). Further, the wedge pushing-up portion (9K) is an upper surface formed in an engagement projecting portion (9K) formed in the upper tool so as to be engageable with and disengageable from an engagement groove portion (17K) formed in the wedge-shaped member (17).

Further, the upper tool for a press brake according to the present invention, it is possible to facilitate mounting and dismounting of the upper tool to and from the upper tool holder device, in the mechanism by which the upper tool clamping force can be increased gradually when the upper tool is moved upward relative to the support plate of the upper tool holder device. Further, since a sufficient clamping force can be obtained whenever the upper tool is mounted to the upper tool holder device, it is possible to prevent the upper tool from being dropped from the upper tool holder device due to insufficient clamping force, while preventing difficulty in dismounting the upper tool from the upper tool holder device due to an excessive tool clamping force. Furthermore, since the upper tool is held in place by the upper tool holder device whenever the upper tool is being replaced, it is possible to improve the safety of upper tool exchange process.

What is claimed is:

1. An upper tool assembly for a press brake, comprising:

an upper tool holder device having a holder body provided with a support plate and an upper tool clamp pivotably attached to said holder body and providing a clamping force; said support plate having a lower surface and a side surface for engaging with an upper tool, said upper tool clamp having a lower portion and an upper portion;

a wedge-shaped member located at said lower portion of said upper tool clamp and movable in a vertical up and down direction from said lower portion of said upper tool clamp toward said upper portion of said upper tool clamp;

an upper tool having a longitudinal wedge-pushing up portion formed therein transverse to said vertical up and down direction for pushing upward said wedge-shaped member, a contact surface for contacting said support plate lower surface, a slide surface for slidably contacting said support plate side surface, and a processing portion for processing a workpiece, said upper tool removably positionable above a workpiece to be processed and attachable between said support plate and said upper tool clamp;

wherein movement of said upper tool vertically upward relative to said support plate causes engagement of said wedge pushing-up portion and said wedge-shaped member so as to increase the upper tool clamping force of said upper tool clamp.

2. The upper tool assembly of claim 1, wherein said wedge-shaped member further comprises an engagement projecting portion and said wedge pushing-up portion further comprises an engagement groove portion formed in the upper tool and having a lower surface, said wedge pushing up portion formed so as to be engageable with and disengageable from said engagement projecting portion of the wedge-shaped member.

3. The upper tool assembly of claim 2, wherein said wedge-shaped member engagement projecting portion further comprises an upper surface and said engagement groove portion further comprises an upper engagement surface engageable with said upper surface of said engagement projecting portion of the wedge-shaped member for prevention of the upper tool from being dropped from the upper tool holder device.

4. The upper tool assembly of claim 1, wherein said wedge-shaped member further comprises an engagement groove and said wedge pushing-up portion further comprises an engagement projecting portion formed in the upper tool and having an upper surface so as to be engageable with and disengageable from said engagement groove formed in the wedge-shaped member.

5. The upper tool assembly of claim 1, wherein the tool assembly further comprises:

an elastic member for pushing the upper tool clamp, said elastic member having an elastic modulus; a pivotal center defined between the upper toot clamp and the elastic member; a push actuating portion through which portion the upper tool clamp wedge-shaped member pushes the upper tool against the support plate, thereby creating a pushing force; said wedge-shaped member having an inclination angle; wherein further upon engagement of the wedge pushing-up portion in loose contact with the wedge-shaped member to push the wedge-shaped member upward, a space H is created between the lower surface of the support plate and the contact surface of the upper tool and is given by an expression as follows:

$$H=(B^2\cdot P)/(A^2\cdot K\cdot \tan\theta)$$

where:

A denotes a dimension between the pivotal center of the upper tool clamp and the elastic member for pushing the upper tool clamp; B denotes an average dimension between the pivotal center and the push actuating portion at which the upper tool clamp pushes the upper tool against the support plate via the wedge-shaped member; P denotes the pushing force for pushing the upper tool against the support plate; K denotes the elastic modulus of the elastic member; and θ denotes the inclination angle of the wedge-shaped member.

6. An upper tool assembly for a press brake, comprising:

an upper tool holder device having a holder body provided with a support plate and an upper tool clamp pivotally attached to said holder body and providing a clamping force; said support plate having a lower surface and a side surface for engaging with an upper tool, said upper tool clamp having a lower portion and an upper portion;

a wedge-shaped member located at said lower portion of said upper tool clamp and movable in a vertical up and down direction from said lower portion of said upper tool clamp toward said upper portion of said upper tool clamp, said wedge-shaped member having a stop projection formed therein;

an upper tool having a longitudinal engagement groove portion formed therein transverse to said vertical up and down direction and engageable with and disengageable from said wedge-shaped member stop projection for pushing upward said wedge-shaped member, a contact surface for contacting said support plate lower surface, a slide surface for slidably contacting said support plate said surface, and a processing portion for processing a workpiece, said upper tool removeably positionable above a workpiece to be processed and attachable between said support plate and said upper tool clamp;

wherein movement of said upper tool vertically upward relative to said support plate causes engagement of said tool engagement groove and said wedge-shaped member stop projection so as to increase the upper tool clamping force of said upper tool clamp.

7. The upper tool assembly of claim 6, wherein said engagement groove further includes a pressing surface for pressing the stop projection of the wedge-shaped member so as to drive the wedge-shaped member.

8. The upper tool assembly of claim 6, wherein said engagement groove further includes a falling away preventing surface for preventing said upper tool from falling away from the wedge-shaped member.

9. The upper tool assembly of claim 6, wherein said engagement groove further includes a pressing surface for pressing the stop projection of the wedge-shaped member so as to drive the wedge-shaped member and a falling away preventing surface for preventing said upper tool from falling away from the wedge-shaped member.

10. An upper tool assembly for a press brake, comprising:

an upper tool holder device having a holder body provided with a support plate and an upper tool clamp pivotally attached to said holder body and providing a clamping force; said support plate having a lower surface and a side surface for engaging with an upper tool, said upper tool clamp having a lower portion and an upper portion;

a wedge-shaped member located at said lower portion of said upper tool clamp and movable in a vertical up and down direction from said lower portion of said upper tool clamp toward said upper portion of said upper tool clamp, said wedge-shaped member having a longitudinal stop groove formed therein;

an upper tool having a longitudinal engagement projection formed therein transverse to said vertical up and down direction and engageable with and disengageable from a contact surface for contacting said support plate lower surface, a slide surface for slidably contacting said support plate side surface, and a processing portion for processing a workpiece, said upper tool removably positionable above a workpiece to be processed and attachable between said support plate and said upper tool clamp;

wherein movement of said upper tool vertically upward relative to said support plate causes engagement of said upper tool engagement projection and said wedge-shaped member stop groove so as to increase the upper tool clamping force of said upper tool clamp.

11. The upper tool assembly of claim 10, wherein said stop groove further comprises an inner surface and said engagement projection further comprises a pressing surface for pressing said inner surface of the stop groove of the wedge-shaped member so as to drive the wedge-shaped member.

12. The upper tool assembly of claim 10, wherein said stop groove further comprises an inner surface and said engagement projection further comprises a falling away preventing surface for coming into contact with said inner surface of the stop groove of the wedge-shaped member to prevent said upper tool from falling away from the wedge-shaped member.

13. The upper tool assembly of claim 10, wherein said stop groove further comprises an inner surface and said engagement projection further comprises a pressing surface for pressing said inner surface of the stop groove of the wedge-shaped member so as to drive the wedge-shaped member and a falling away preventing surface for coming into contact with said inner surface of the stop groove of the wedge-shaped member to prevent said upper tool from falling away from the wedge-shaped member.

* * * * *